US010898034B1

(12) United States Patent
Arminak

(10) Patent No.: US 10,898,034 B1
(45) Date of Patent: Jan. 26, 2021

(54) ALL PLASTIC HAND FOAM PUMP

(71) Applicant: Armin Arminak, Pasadena, CA (US)

(72) Inventor: Armin Arminak, Pasadena, CA (US)

( * ) Notice: Subject to any disclaimer, the term of this patent is extended or adjusted under 35 U.S.C. 154(b) by 0 days.

(21) Appl. No.: 16/917,198

(22) Filed: Jun. 30, 2020

Related U.S. Application Data

(60) Provisional application No. 62/869,978, filed on Jul. 2, 2019.

(51) Int. Cl.
*A47K 5/14* (2006.01)
*B05B 7/00* (2006.01)
*B05B 11/00* (2006.01)

(52) U.S. Cl.
CPC ..... *A47K 5/14* (2013.01); *B05B 7/0018* (2013.01); *B05B 11/3077* (2013.01)

(58) Field of Classification Search
CPC ..... A47K 5/14; B05B 11/3077; B05B 7/0018
See application file for complete search history.

(56) References Cited

U.S. PATENT DOCUMENTS 5,443,569 A * 8/1995 Uehira ..... B05B 7/0031 222/190
6,138,875 A 10/2000 Condon
6,367,663 B1 4/2002 Condon
7,246,723 B2 7/2007 Santagiuliana
7,357,278 B2 4/2008 Navarro
7,802,701 B2 * 9/2010 Jahan ..... B05B 11/3047 222/153.13
8,297,475 B2 * 10/2012 Limbert ..... B05B 11/3087 222/190
8,499,981 B2 8/2013 Quinlan
10,335,816 B1 7/2019 Arminak
2005/0008576 A1 1/2005 Makansi
2005/0239675 A1 10/2005 Makansi
(Continued)

FOREIGN PATENT DOCUMENTS

CA 2465887 C 6/2009
JP 10511303 A 11/1998
(Continued)

OTHER PUBLICATIONS

Patent Cooperation Treaty—International Searching Authority, PCT Notification of Transmittal of the International Search Report and the Written Opinion of the International Searching Authority, or the Declaration regarding Application No. PCT/US2020/40451 dated Sep. 30, 2020, 11 pp.

*Primary Examiner* — David P Angwin
*Assistant Examiner* — Bob Zadeh
(74) *Attorney, Agent, or Firm* — Cislo & Thomas, LLP

(57) ABSTRACT

A hand foam pump fabricated entirely from plastic components for dispensing foamable liquids, is provided. The hand foam pump includes an actuator, a closure, a housing, cylinder bores for an air piston and a liquid piston within the housing and an air piston and a liquid piston fixed to a stem, wherein the air and liquid pistons are reciprocally mounted within the cylinder bores, and check valves, among other components. An elastic, dome shaped, plastic return spring is utilized to return the actuator to its rest position after actuation. The plastic return spring is positioned over the closure and below the actuator. The all plastic hand foam pump is suitable for dispensing foamable liquids from a dispenser bottle. Used pumps do not require disassembly to be recycled.

17 Claims, 19 Drawing Sheets

(56) References Cited

U.S. PATENT DOCUMENTS

| | | | | |
|---|---|---|---|---|
| 2007/0119864 | A1* | 5/2007 | Tsai | B05B 11/3087 222/137 |
| 2010/0314417 | A1* | 12/2010 | Lee | B05B 7/0037 222/190 |
| 2012/0104048 | A1* | 5/2012 | Tseng | B05B 7/0037 222/190 |
| 2012/0241477 | A1* | 9/2012 | Uehira | B05B 7/0037 222/190 |
| 2013/0048755 | A1* | 2/2013 | Uehira | B05B 11/3087 239/318 |
| 2014/0097209 | A1* | 4/2014 | Kim | B05B 7/0037 222/190 |
| 2015/0352580 | A1* | 12/2015 | Kakuta | B05B 7/0031 222/190 |
| 2016/0332181 | A1* | 11/2016 | DeMan | B05B 11/3001 |
| 2017/0265691 | A1 | 9/2017 | Ophardt et al. | |
| 2017/0326567 | A1 | 11/2017 | Santagiuliana | |

FOREIGN PATENT DOCUMENTS

| | | | |
|---|---|---|---|
| JP | 3848362 | B2 | 11/2006 |
| JP | 4294103 | B2 | 7/2009 |
| JP | 5412106 | B2 | 2/2014 |

* cited by examiner

ALL PLASTIC HAND FOAM PUMP

CROSS-REFERENCES TO RELATED APPLICATION

This application claims the benefit of U.S. Provisional Application Ser. No. 62/869,978, filed Jul. 2, 2019 and entitled "All Plastic Hand Foam Pump," which is incorporated here by this reference.

BACKGROUND OF THE INVENTION

Field of the Invention

This invention relates to hand operated liquid dispensing pumps used in the personal care industry and, in particular, to hand pumps capable of foaming a liquid and dispensing the foamed product.

Background Art

Hand operated dispensing pumps are well-known in the personal care industry for dispensing fluid products such as liquids, including foamable liquids, and creams. The majority of pumps for dispensing liquids, foamable liquids and creams presently available are made from plastic but include at least a metal compression spring to return the pump actuator to its starting position after being depressed. Typically, hand operated dispensing pumps are pre-installed on a fluid filled container prior to sale and are disposed of along with the container when the contents of the container are depleted. The pumps are not typically intended to be reused. Although pumps using metal return springs operate effectively, and are of relatively low cost to make, they have certain drawbacks. In particular, the steel compression springs typically used in such pumps may cause rust contamination of the product to be dispensed and makes the pumps difficult to recycle.

Plastic parts are recycled by grinding or shredding the parts. The shredded material may then be reused, typically by melting the material and mixing it with new plastic. To be suitable for grinding or shredding, used plastic must be free of any metal parts. A hand pump using a metal return spring, or any metal components, must be disassembled to remove the metal components prior to recycling the plastic materials which compose the bulk of the pump. The need to disassemble a used hand pump to remove the metal components prior to recycling increases costs and has the effect of decreasing the desirability of used hand pumps as a source of recycled plastic. Thus, there is a need in the art for a hand pump capable of foaming and dispensing a foam product made from all plastic components. Such pumps would require no disassembly prior to being ground or shredded for use as recycled plastic.

SUMMARY OF THE INVENTION

The present invention meets a long-felt need in the art by providing a new hand pump design for dispensing a foamable liquid that is fabricated entirely from plastic materials. The all plastic hand foam pump of the present invention eliminates potential contamination of the product to be dispensed due to rusting of the steel compression springs typically found in prior art hand pumps and is easy to recycle.

The major components of the hand foam pump of the present invention comprise an actuator, a pump body, a closure, a plastic return spring, a stem, a mixing cylinder, an air piston, a liquid piston, a diaphragm, and a ball-style check valve. Other components include a liquid piston retainer, a closure to pump body gasket and a dip tube.

The actuator of the hand foam pump is fixed to, and in fluid communication with, the stem at an upper end of the stem. The air piston is fixed to an upper portion of the stem and a liquid piston is affixed to a lower portion of the stem. The connection between the stem and the liquid piston is configured such that the liquid piston may slide over a predefined length of the stem, where such sliding motion opens and closes, i.e. covers and uncovers, lower liquid ports in the stem. The stem is in fluid communication via the lower liquid ports with a liquid cylinder of the pump body. Upon a downstroke of the actuator the lower liquid ports in the stem are opened and upon an upstroke of the actuator, the lower liquid ports are closed. The liquid cylinder is, via a check valve, in fluid communication with a dip tube immersed in a container of fluid to be foamed and dispensed.

The pump body of the hand foam pump of the present invention includes an air cylinder and the liquid cylinder, within which reciprocate the air piston and the liquid piston, respectively. The air piston is configured to receive a diaphragm, where the diaphragm functions to close air vents formed within the air piston on a downstroke of the actuator and open the air vents on an upstroke of the actuator. An elastic, dome shaped, plastic return spring is disposed between the actuator and the pump closure to return the actuator to its rest position after actuation.

The hand foam pump of the present invention operates as follows. In a first step, to prime the pump a user presses down on the actuator which causes the stem and the air piston to move downwardly within the air cylinder of the pump body. During this downwards movement, the liquid piston which is slidably connected to the stem, remains stationary in the liquid cylinder of the pump body. As the stem moves downwardly within the liquid cylinder, the lower fluid ports are opened or uncovered. Also during downward movement of the actuator and consequently, the stem, the diaphragm seals the vent holes in the air piston. With the vent holes in the air piston sealed, air is forced to flow through air feed channels between the stem and the air piston. The air feed channels are defined by the arcuate cutouts in an upper flange of the stem.

In a second step, when hand pressure is removed from the actuator, the plastic return spring, pushes the actuator upwardly, causing the connected stem and air piston to also move upwardly within the pump body. As the stem moves upwardly, the lower liquid ports are again closed or covered by the liquid piston, and, at the same time the diaphragm opens or uncovers the vent holes in the air piston, thereby allowing air into the air cylinder of the pump body. As the lower liquid ports in the stem are closed, by the stem moving upwardly with respect to the liquid piston, the resulting pressure differential in the liquid cylinder causes the check valve to open, i.e. causes the check ball to rise upwardly off its seat, thereby causing liquid to be drawn upwardly within the liquid cylinder. The liquid is supplied to the liquid cylinder via a dip tube inserted within a volume of liquid in a dispensing bottle.

Steps 1 and 2 complete the priming cycle of the hand foam pump of the present invention. In a third step, the actuator is again pushed down by a user causing the stem and the air piston affixed thereto to again move downwardly in the pump body. The liquid piston again remains stationary as the stem moves downwardly though the liquid piston, thereby uncovering the lower liquid ports in the stem. The downward movement of the stem causes the check ball to seat and close the check valve, which in turn causes the liquid in the liquid cylinder to be forced upwardly through the lower liquid ports and into a flow passage of the stem.

Simultaneously with the downward movement of the stem, downward movement of the air piston (fixed to the stem), causes air to be forced upwardly through the air feed channels between the stem and air piston, where the air mixes with the liquid just below the first mesh of the mixing cylinder, thereby generating foam. The foamed liquid then travels upwardly through the first mesh of the mixing cylinder and subsequently through the second mesh of the mixing cylinder and through a vertical flow passage of the actuator and through a horizontal flow passage of the actuator, wherein the foamed liquid is dispensed from the actuator.

Additional foamed liquid is dispensed with each subsequent downward press of the actuator. During all operations, the plastic return spring of the pump acts as a compression spring and provides the force necessary to drive the stem and attached air piston and liquid piston upwardly on the upstroke.

The above and other advantages of the all plastic hand foam pump of the present invention will be described in more detail below.

DETAILED DESCRIPTION OF THE PREFERRED EMBODIMENTS

Figure 1A:
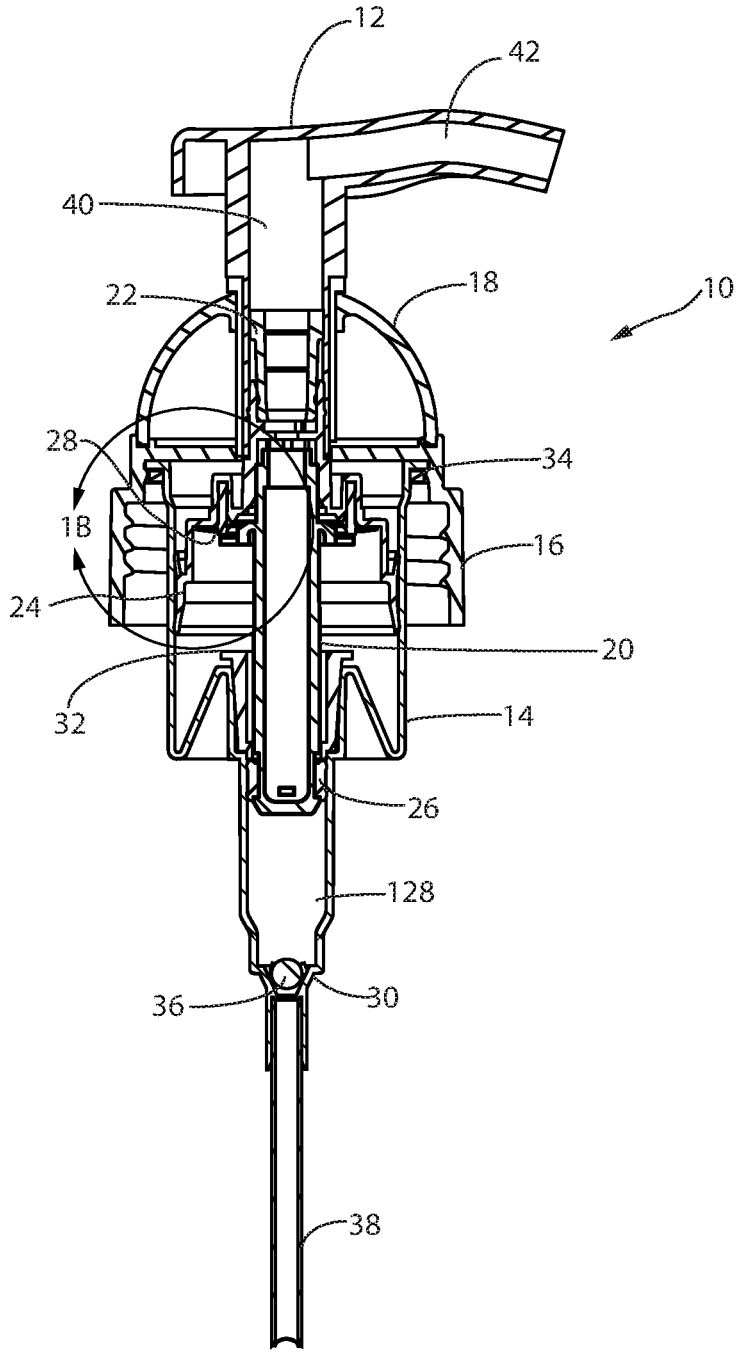
FIG. 1A is a cross-sectional view of the hand foam pump of the present invention with the actuator in the raised or at rest position.

The present invention will now be described more fully hereinafter with reference to the accompanying drawings, in which preferred embodiments of the invention are shown. The invention however, may be embodied in many different forms and should not be construed as being limited to the embodiments set forth herein. Rather these embodiments are provided so that this disclosure will be thorough and complete, and will fully convey the scope of the invention to those skilled in the art. Like numbers refer to like elements throughout.

Description of the Component Parts

With reference to FIGS. 1A-1C and 2, the major components of the hand foam pump of the present invention 10 comprise an actuator 12, a pump body 14, a closure 16, a plastic return spring 18, a stem 20, a mixing cylinder 22, an air piston 24, a liquid piston 26, a diaphragm 28 and, a ball-style check valve 30. The hand foam pump 10 also includes a liquid piston retainer 32, a pump body gasket 34, a check ball 36 and, a dip tube 38.

With reference to FIGS. 1A-1C, 2 and 3A-3E, the actuator 12 includes an upper portion 58, a lower portion 60, a vertical flow passage 40 and a dispensing flow passage 42. The upper portion 58 features a contoured pressing element 56 and a dispensing nozzle 52. The lower portion 60 includes a generally cylindrical slide portion 54 which includes a pair of vertical guide grooves 44, which are spaced 180 degrees apart in the exemplary embodiment. The lower portion 60 also includes arcuate locking grooves 46 which extend radially from each vertical guide groove 44. The arcuate locking grooves 46 are each bounded by stop surfaces 62 and 50, wherein a locking detent 48 is disposed in each locking groove 46. The lower portion 60 further includes a pair of venting channels 45, which, in the exemplary embodiment, are spaced 180 degrees apart from each other and are spaced 48 degrees from the nearest guide groove 44. Disposed at the top of each vertical guide groove 44 and venting channel 45 is a vent 61. The vents 61 serve to vent the interior of the plastic return spring 18 to the atmosphere during operation of the spring and reduce whistling noises during pump operation.

Figure 5A:
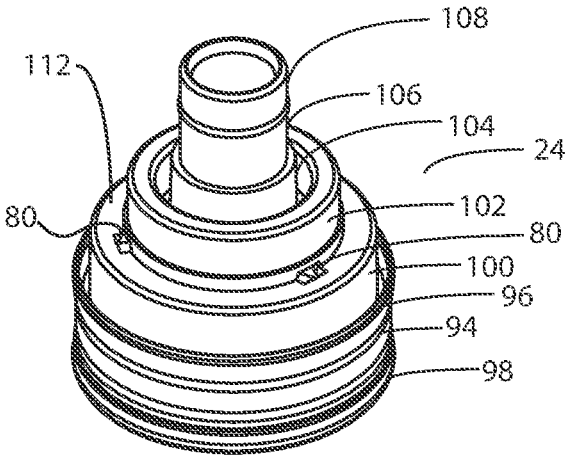
FIG. 5A is a perspective view of the air piston of the hand foam pump of FIG. 1A.
Figure 5B:
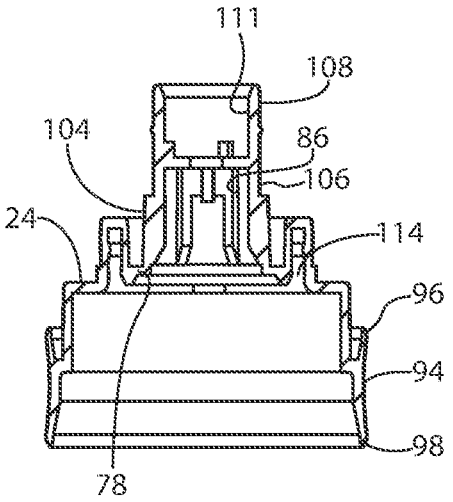
FIG. 5B is a cross-sectional view of air piston of the hand foam pump of FIG. 1A.
Figure 6A:
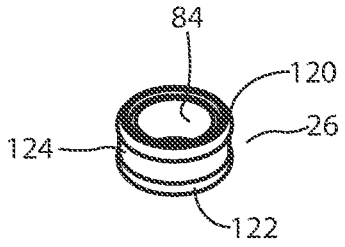
FIG. 6A is a perspective view of the liquid piston of the hand foam pump of FIG. 1A.
Figure 6B:
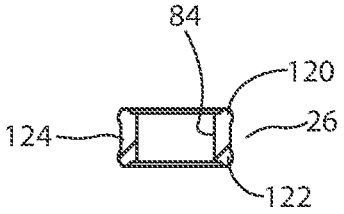
FIG. 6B is a cross-sectional view of the liquid piston of the hand foam pump of FIG. 1A.

With reference to FIGS. 1A-1C, 2 and 4A-4B, the stem 20 has a generally cylindrical body 68 having an upper end 82 and a lower end 81, with an internal flow passage 64 therebetween. Disposed near a base or bottom of the lower end 81 are lower liquid ports 66. Disposed along the generally cylindrical body 68 of the stem 20 is an upper flange 72. The upper flange 72 includes arcuate cutouts 74 which form air feed channels 76 (see FIG. 1B) between the stem and cylindrical interior surfaces 78 of the air piston. (See FIG. 5B.) The lower end 81 of the stem 20 includes a liquid piston retainer portion 70 which is an exterior cylindrical surface of the stem 20 bounded by an upper cylindrical stop surface 88 and a lower cylindrical stop surface 90, and which is configured to be in a slip-fit relationship with a bore or interior cylindrical surface 84 of the liquid piston 26. (See FIG. 6B.) The upper end 82 of the stem 24 includes an exterior cylindrical surface 79 which is bounded at a lower end by a cylindrical stop surface 92 and which is configured to be in a press fit relationship with an interior cylindrical surface 86 of the air piston 24.

Figure 7A:
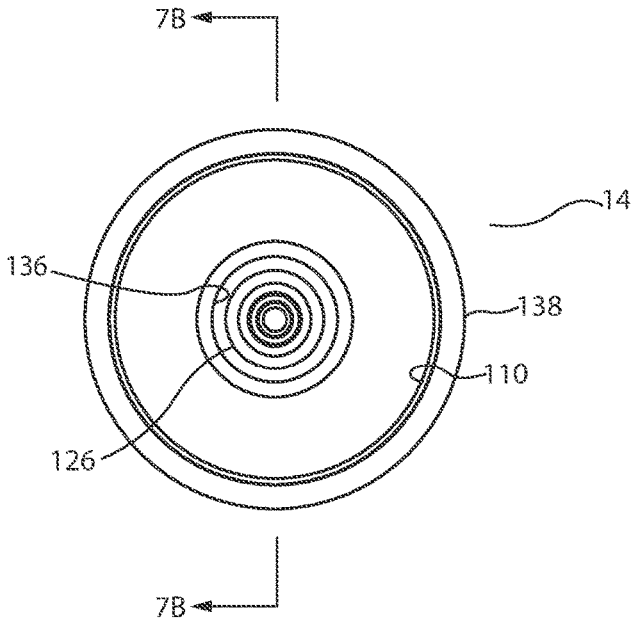
FIG. 7A is a top view of the pump body of the hand foam pump of FIG. 1A.
Figure 7B:
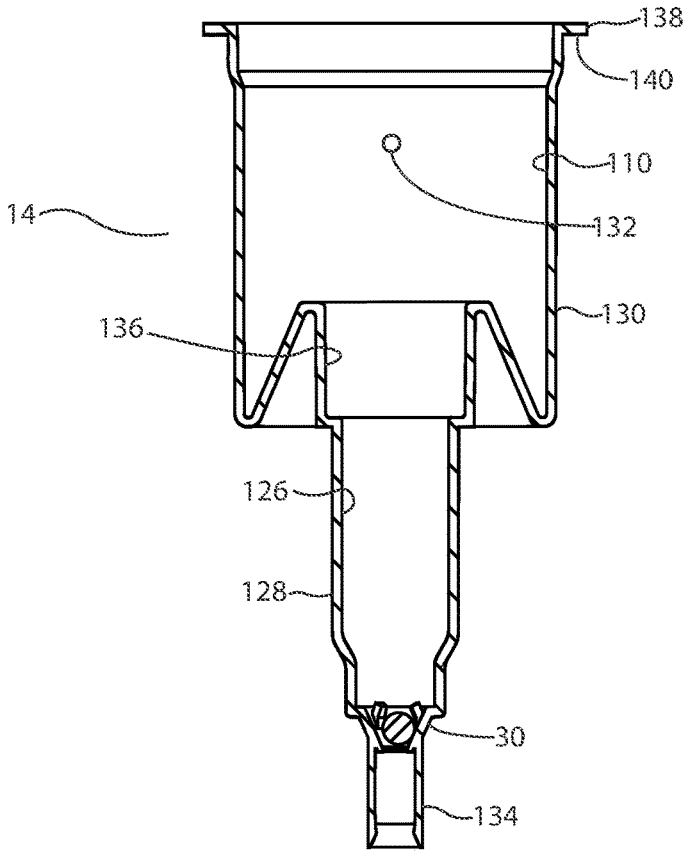
FIG. 7B is a cross-sectional view of the pump body of the hand foam pump of FIG. 1A.
Figure 8A:
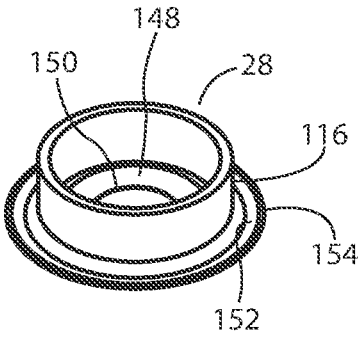
FIG. 8A is a perspective view of the diaphragm of the hand foam pump of FIG. 1A.
Figure 8B:
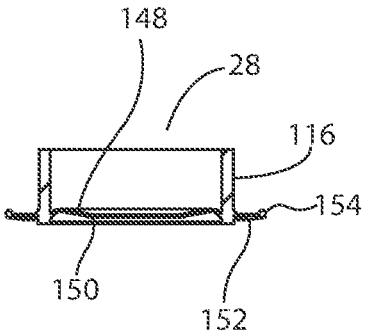
FIG. 8B is a cross-sectional view of the diaphragm of the hand foam pump of FIG. 1A.
Figure 9A:
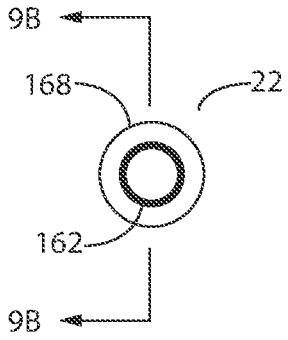
FIG. 9A is a top view of the mixing cylinder of the hand foam pump of FIG. 1A.
Figure 9B:
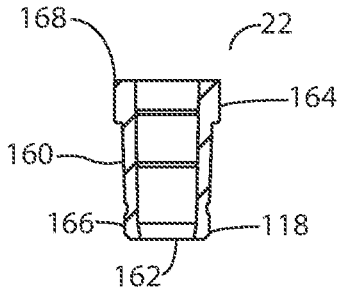
FIG. 9B is a cross-sectional view of the mixing cylinder of the hand foam pump of FIG. 1A.
Figure 9C:
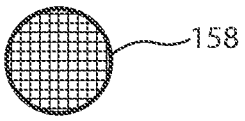
FIG. 9C is a top view of a first or lower mesh of the hand foam pump of FIG. 1A.
Figure 9D:
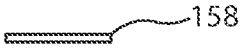
FIG. 9D is a side view of the first or lower mesh of FIG. 9C.
Figure 9E:
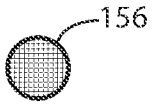
FIG. 9E is a top view of a second or upper mesh of the hand foam pump of FIG. 1A.
Figure 9F:
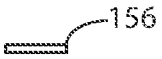
FIG. 9F is a side view of the second or upper mesh of FIG. 9E.
Figure 10A:
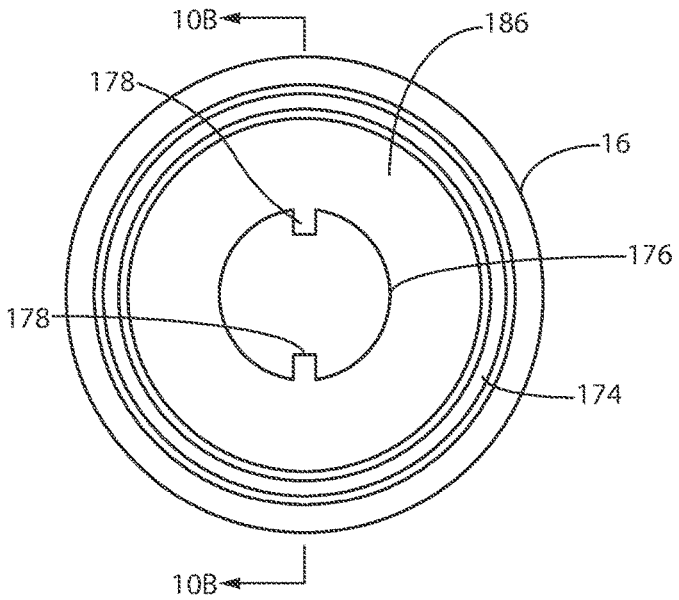
FIG. 10A is a top view of the closure of the hand foam pump of FIG. 1A.
Figure 10B:
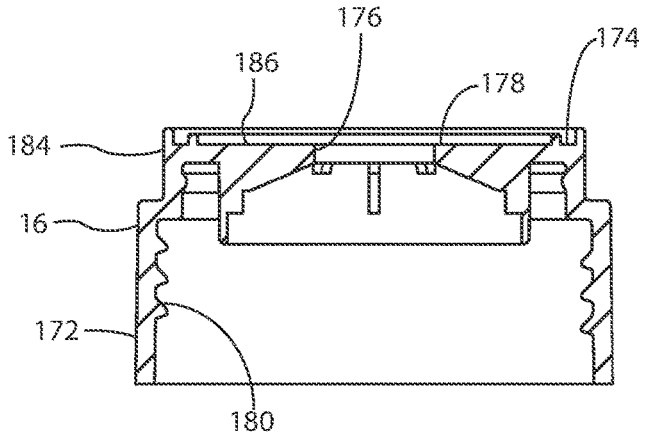
FIG. 10B is a cross-sectional view of the closure of the hand foam pump of FIG. 1A.
Figure 11A:
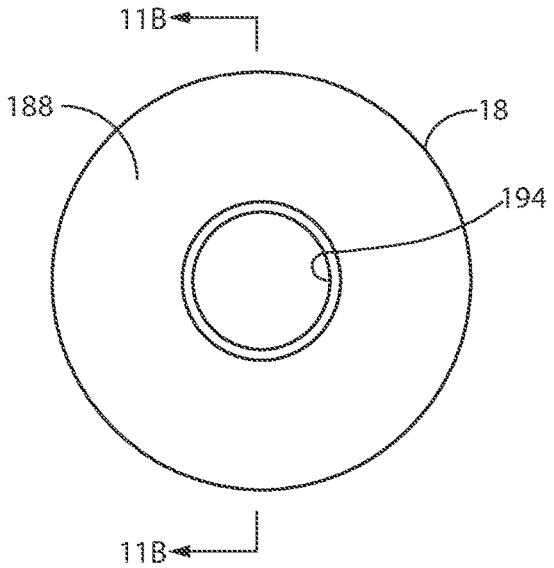
FIG. 11A is a top view of the dome shaped plastic spring of the hand foam pump of FIG. 1A.
Figure 11B:
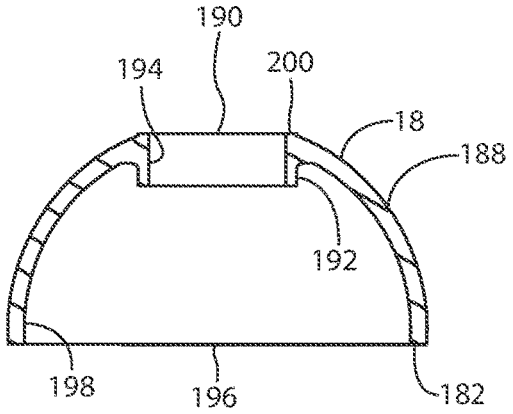
FIG. 11B is a cross-sectional view of the dome shaped plastic spring of FIG. 11A.
Figure 12A:
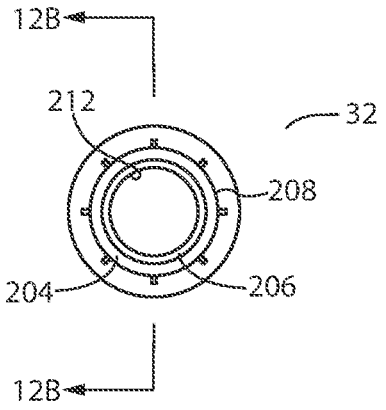
FIG. 12A is a bottom view of the liquid piston retainer of the hand foam pump of FIG. 1A.
Figure 12B:
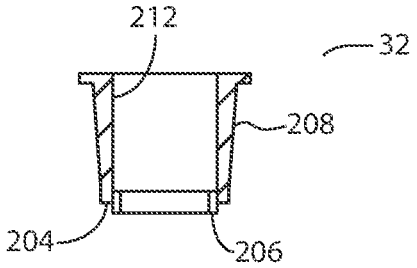
FIG. 12B is a cross-sectional view of the liquid piston retainer of the hand foam pump of FIG. 1A.
Figure 13A:
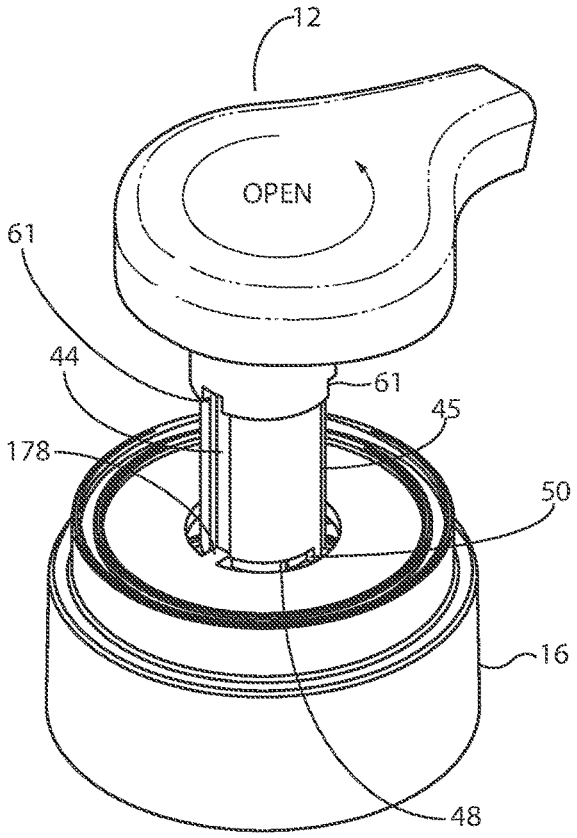
FIG. 13A is a perspective view showing the locking features of the actuator and closure of the hand foam pump of FIG. 1A, in the locked condition.
Figure 13B:
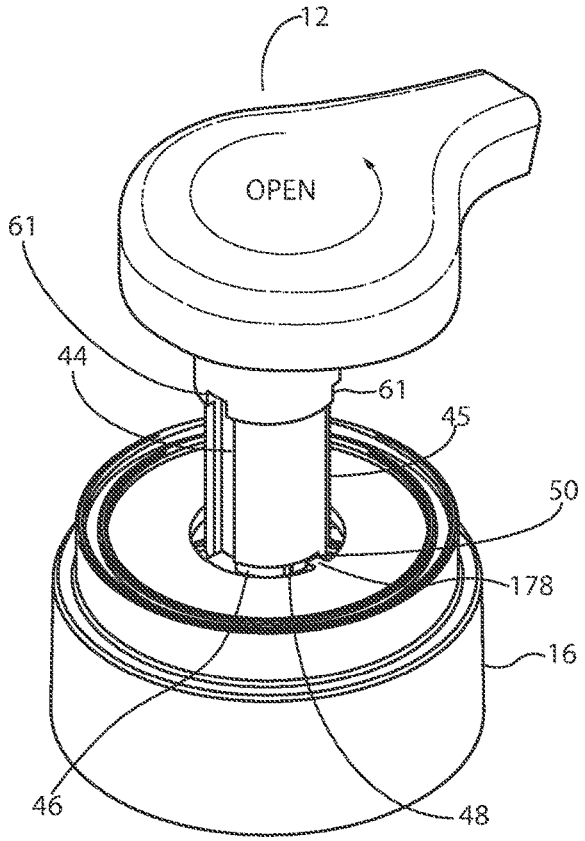
FIG. 13B is a perspective view showing the locking features of the actuator and closure of the hand foam pump of FIG. 1A, in the unlocked condition.

With reference to FIGS. 1A-1C, 2 and 5A-5B, the air piston 24 is a one-piece element comprising multiple cylindrical sections. The air piston 24 includes a reciprocating element 94, a lower body portion 100, a mid-flange 112, a diaphragm retainer portion 102, a mid-body portion 104, a stem retainer portion 106 and, a mixing cylinder retainer portion 108. The reciprocating element 94 has an upper sealing ring 96 and a lower sealing ring 98. The upper and lower sealing rings 96 and 98 seal the reciprocating element 94 of the air piston 24 to a bore 110 of the pump body 14. (See FIG. 7B.) The mid-flange 112 includes a plurality of air vents 80. The diaphragm retainer portion 102 has an interior cylindrical channel 114 which is configured to retain in a press fit relationship a cylindrical wall 116 of the diaphragm 28. (See FIG. 8B.) The stem retainer portion 106 has in internal cylindrical wall 86 configured to be in a press fit relationship with the exterior cylindrical surface 79 of the stem 20. The mixing cylinder retainer portion 108 has an internal cylindrical wall 111 configured to be in a press fit relationship with the exterior cylindrical surface 118 of the mixing cylinder 22.

With reference to FIGS. 1A-1C, 2 and 6A-6B, the liquid piston 26 is a hollow cylindrical element having a bore or interior cylindrical surface 84 and an exterior surface 124. The exterior surface 124 includes an upper bulbous sealing ring 120 and a lower bulbous sealing ring 122. The upper and lower bulbous sealing rings 120 and 122 seal against the cylindrical bore 126 of the liquid cylinder 128 of the pump body 14.

With reference to FIGS. 1A-1C, 2 and 7A-B, the main body 14 of the present invention hand foam pump 10 is a one-piece component that includes internally an air cylinder 130 having a first cylindrical bore 110 in which reciprocates or slides the air piston 24, and a fluid cylinder 128 having a cylindrical bore 126 in which reciprocates or slides the liquid piston 26. Disposed within the air cylinder 130 and below the first cylindrical bore 110 is a second cylindrical bore 136 which receives in a press fit relationship the liquid piston retainer 32. Disposed adjacent to and below a lower end of the liquid cylinder is a check valve 30 having a check ball 38. Disposed below the check valve 30 is a tubular portion 134 which is configured to receive the dip tube 38. (See FIG. 1C.) The pump body 14 further includes a vent hole 132 which vents the pump body to atmosphere, and a retention flange 138. The retention flange 138 is configured to affix to the closure 16 via a press or snap fit and, includes a circular sealing surface 140 for receipt the gasket 34, which seals a container 142 containing fluid to be foamed and dispensed 144 to the hand foam pump 10.

With reference to FIGS. 1A-1C, 2 and 8A-B, the diaphragm 28 of the present invention hand foam pump 10 includes a wall element 116, an inner ring shaped flange 148 and an outer ring shaped flange 152. The outer ring shaped flange 152 features a bulbous ring shaped sealing lip 154, which on a downstroke of the actuator 12 contacts the air piston 24 and seals the air vents 80 in the air piston 24. (See FIG. 5A.) The inner ring shaped flange 148 also includes a bulbous sealing lip 150 which rests upon a beveled circular flange 146 of the stem 20. (See FIG. 4A.)

With reference to FIGS. 1A-1C, 2 and 9A-B, the mixing cylinder 22 of the hand foam pump 10 of the present invention is generally cylindrical with a center section 160, an upper portion 164, and a lower portion 166. The upper portion 164 of the mixing cylinder 22 has an outside diameter 168 configured to be a press fit with an interior diameter 170 (see FIG. 3B) of the vertical flow passage 40 of the actuator 12. The lower portion 166 has an exterior diameter 118 configured to be a press fit with an interior bore 111 (see FIG. 5*b*) of the air piston 24. The mixing cylinder 22 has an interior cylindrical passage or bore 162.

With reference to FIGS. 9C-9F, the hand foam pump 10 includes a first or lower mesh 158 and a second or upper mesh 156. In the exemplary embodiment, the upper mesh 156 is a finer mesh than the lower mesh 158. The first mesh 158 is affixed at the lower portion 166 of the mixing cylinder 22 and spans a lower opening of the bore 162. The second mesh 156 is affixed to the top portion 164 of the mixing cylinder 22 and spans a top opening of the bore 162.

With reference to FIGS. 1A-1C, 2 and 10A-B, the closure 16 of the present invention hand foam pump 10 comprises a generally circular lower portion 172 and a generally circular upper portion 184. The lower portion 172 includes screw threads 180 which interface the hand foam pump 10 with the dispenser container 142 containing the fluid to be foamed and dispensed 144. The upper portion 184 includes a circular retaining channel 174 which retains a lower edge of the 182 of the plastic return spring 18. The closure also includes an upper shelf portion 186 which includes a circular opening 176. Protruding into the circular opening 176 are actuator guide elements 178.

With reference to FIGS. 1A-IC, 2 and 11A-B, the plastic return spring 18 of the present invention hand foam pump 10 comprises a generally dome-shaped body portion 188 with a neck portion 192. The plastic return spring 18 includes an upper opening 190 having an inside diameter 194 formed in the neck portion 192 and a lower opening 196 having an inside diameter 198. The inside diameter 194 of the upper neck portion 192 is configured to be in a slip fit relationship with the generally cylindrical slide portion 54 (see FIG. 3A) of the actuator 12. The upper neck portion 192 includes a ring shaped shelf portion 200 which abuts a ring shaped shelf portion 202 (see FIG. 3B) of the actuator 12. The plastic return spring 18 also includes a lower edge portion 182 which is retained within the circular retaining channel 174 (see FIG. 10B) of the closure 16. The plastic return spring 18 functions as a compression spring. In the exemplary embodiment, the plastic return spring 18 spring is made from polyester elastomer. Other elastic materials are also suitable.

With reference to FIGS. 1A-1C, 2 and 12A-B, the liquid piston retainer 32 functions as a guide element for the stem 20 and as a travel stop for the liquid piston 26. The liquid piston retainer 32 is press fit within the second cylindrical bore 136 (see FIG. 7B) of the pump body 14. The liquid piston retainer 32 includes a plurality of gussets 208 to ensure a secure press fit, a ring shaped surface 204 which controls the insertion depth of the liquid piston retainer within second cylindrical bore 136 of the pump body 14 and, a ring shaped surface 206 which acts as a travel stop for the liquid piston 26. The bore 212 of the liquid piston retainer is sized to from a slip fit with the outside diameter of the cylindrical body 68 of the stem 20.

Assembly of the Hand Foam Pump

With reference to FIGS. 1A to 11B, the following are exemplary steps to assemble the hand foam pump 10 of the present invention. In a first step, the diaphragm 28 is affixed to the air piston 24 by means of a press fit, i.e. the wall element 116 of the diaphragm is pressed into the diaphragm retainer portion 102 of the air piston 24. In a second step, the liquid piston 26 is pressed onto the stem 20, i.e. the bore 84 of the liquid piston 26 is pressed over the lower end 81 and onto the liquid piston retainer portion 70 of the stem 20. In a third step, the air piston 24 is pressed onto the stem, i.e. an upper end 82 of the stem 20 is pressed into a stem retainer portion 106 of the air piston 24. In a fourth step, the mixing cylinder 22, with the first mesh 158 and the second mesh 156 attached, is press fit into the air piston 24, i.e. the lower portion 166 of the mixing cylinder 22 is pressed into mixing cylinder retainer portion 108 of the air cylinder 24.

In a fifth step, the plastic return spring 18 is slid onto the actuator 12, i.e. the opening 194 of the neck portion 192 of the plastic return spring 18 is slid over cylindrical slide portion 54 of the actuator 12. In a sixth step, the closure 16 is slid onto the actuator 12, i.e. the circular opening 176 of the closure is slid over cylindrical slide portion 54 of the actuator with the actuator guide elements 178 of the closure aligning with and sliding within the vertical guide grooves 44 of the actuator 12. In a seventh step, a lower edge portion 182 of the plastic return spring 18 is aligned with and placed into the circular retaining channel 174 of the closure 16.

In an eighth step, the liquid piston retainer 32 is pressed into the pump body 14, i.e. the plurality of gussets 208 of the liquid piston retainer 32 are pressed into the second cylindrical bore 136 of the pump body 14. In a ninth step, the gasket 34 is pressed about the pump body 14 and onto the circular sealing surface 140 of the pump body 14.

In a tenth step, the check ball 36 is dropped into the check valve 30. In an eleventh step, the actuator 12 is pressed onto the air piston 24, i.e. the mixing cylinder retainer portion 108 of the air piston 24 is pressed into the vertical flow passage 40 of the actuator. In a twelfth step, the stem 20 and attached air piston 24 and liquid piston 26 are inserted into the air cylinder 130 and liquid cylinder 128, respectively, of the pump body 14, and the pump body 14 is snapped into the closure 16. (See FIG. 1.) In a thirteenth step, prior to installing the hand foam pump 10 on a dispensing container, the dip tube 38 is inserted into the pump body 14.

The vertical flow passage 40 of the actuator 12 of the hand foam pump 10 is in fluid communication with the internal flow passage 64 of the stem 20. The air piston 24 is fixed to the stem 20 at the upper end 82 of the stem 20 and the liquid piston 26 is affixed to the liquid piston retainer portion 70 at the lower end 81 of the stem 20. The connection between the stem 20 and the liquid piston 26 is configured such that the liquid piston 26 may slide over a predefined length of the stem 20, i.e. the liquid piston retainer portion 70, where such sliding motion opens and closes or covers and uncovers, the lower liquid ports 66 in the stem 20. The stem 20 is in fluid communication via the lower liquid ports 66 with the liquid cylinder 128 of the pump body 14. Upon a downstroke of the actuator 12 the lower liquid ports 66 in the stem are opened and upon an upstroke of the actuator 12, the lower liquid ports 66 are closed. The liquid cylinder 128 is, via the check valve 30, in fluid communication with the dip tube 38. The dip tube 38 is, in turn, in fluid communication with a container 142 of fluid 144 to be foamed and dispensed, when the hand foam pump 10 is installed upon a container.

The air piston 24 and the liquid piston 26 reciprocate within the air cylinder 130 and the liquid cylinder 128, respectively, upon each upstroke and downstroke of the actuator 12. The diaphragm 28 attached to the air piston 24 functions to close the air vents 80 formed within the air piston 24 on a downstroke of the actuator 12 and open the air vents 80 on an upstroke of the actuator 12. The plastic return spring 18, disposed between the actuator 12 and the pump closure 16, returns the actuator 12 to its rest position after actuation.

The hand foam pump 10 of the present invention is equipped with the at least one upper air vent 132 (see FIG. 7B) formed in the pump body 14. The upper air vent 132 provides air communication between the interior volume 210 (see FIG. 2) of the pump body 14 above the level of the air piston 24, and the atmosphere. It is necessary to equalize the pressure of the interior volume of the pump body 14 above the level of the air piston 24 to allow the hand foam pump 10 to properly operate.

Operation of the Hand Foam Pump

Figure 1B:
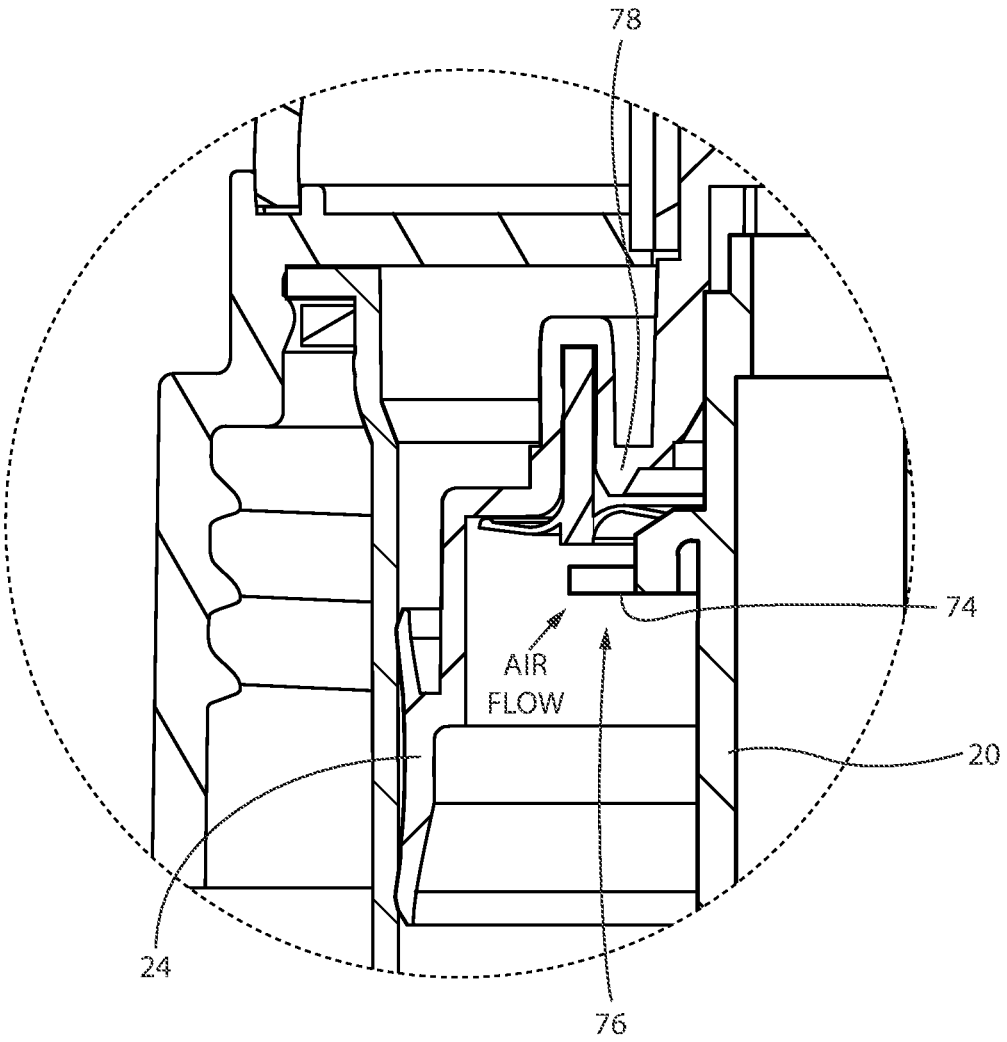
FIG. 1B is an enlarged view of the area shown in circle B of FIG. 1A.
Figure 1C:
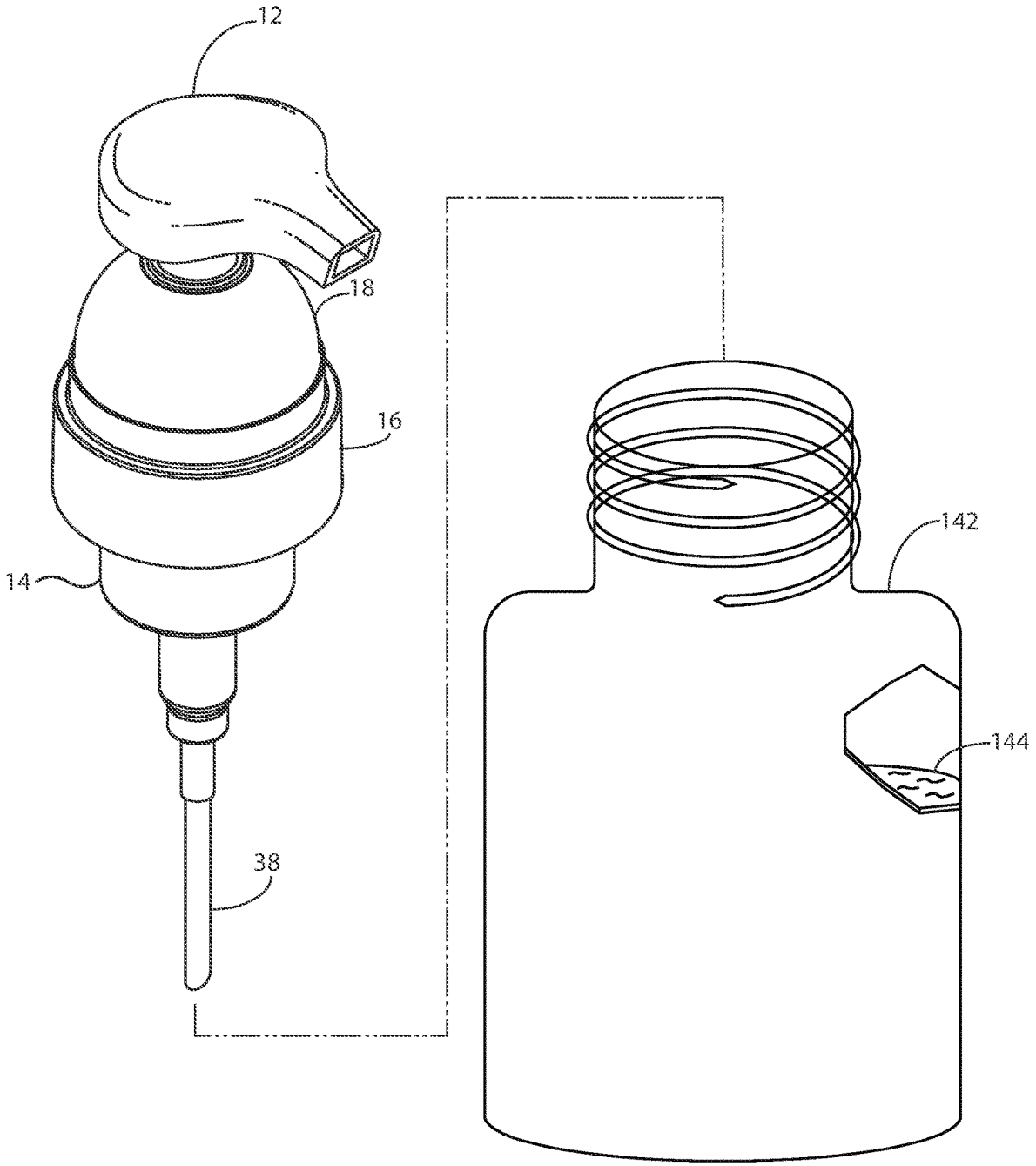
FIG. 1C is a perspective view of the hand foam pump of FIG. 1A shown with an exemplary dispensing container.
Figure 2:
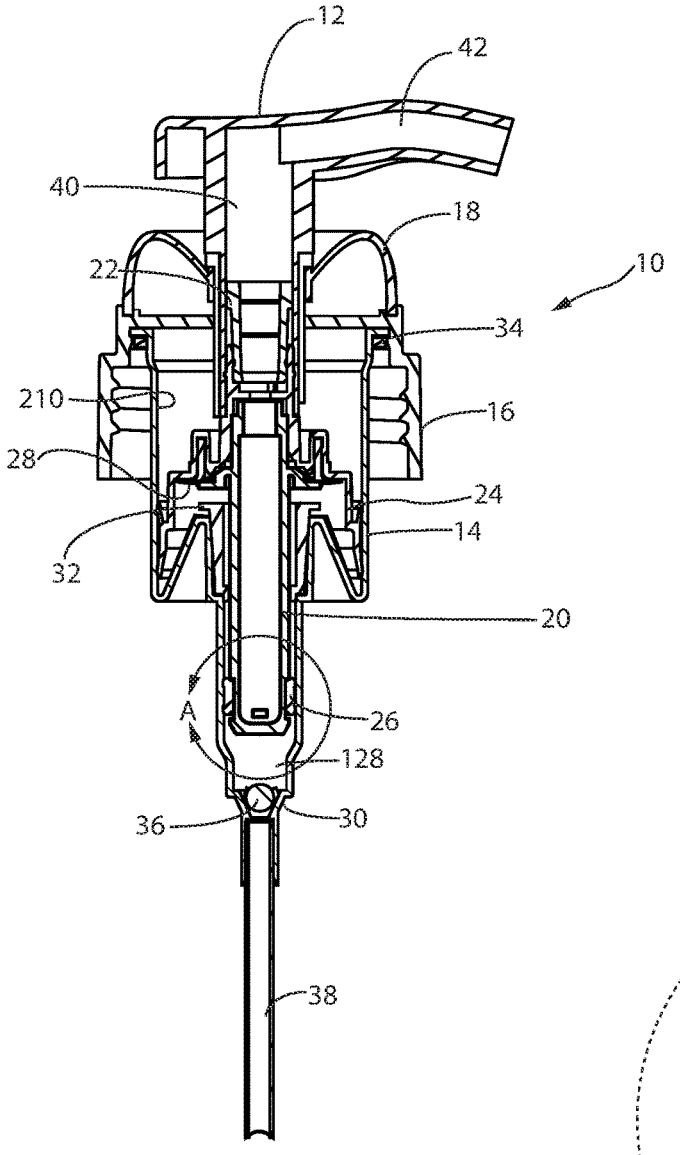
FIG. 2 is a cross-sectional view of the hand foam pump of the present invention, showing the actuator in the depressed position.
Figure 2A:
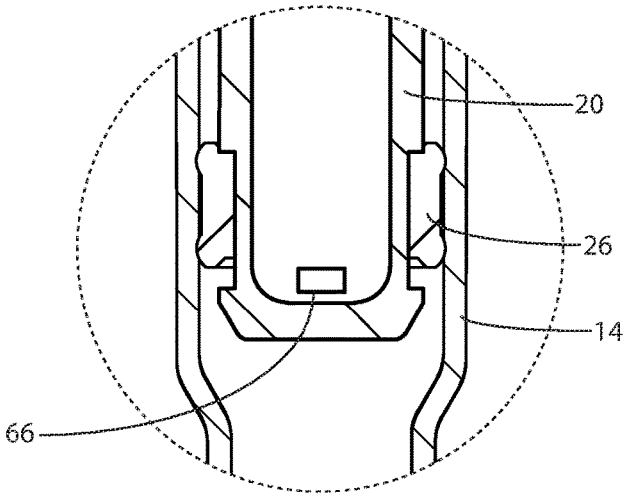
FIG. 2A is an enlarged view of the area shown in circle 2A of FIG. 2.
Figure 3A:
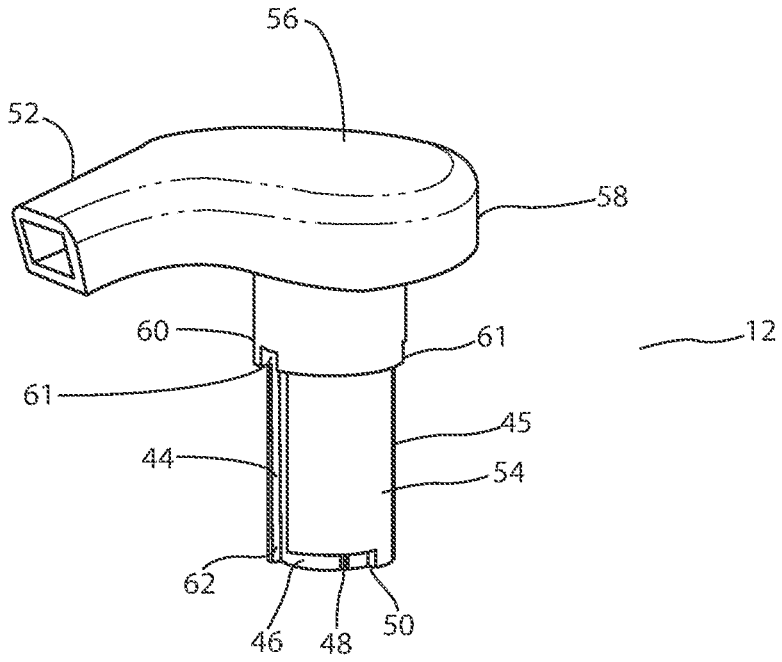
FIG. 3A is a front-side perspective view of the actuator of the hand foam pump of FIG. 1A.
Figure 3B:
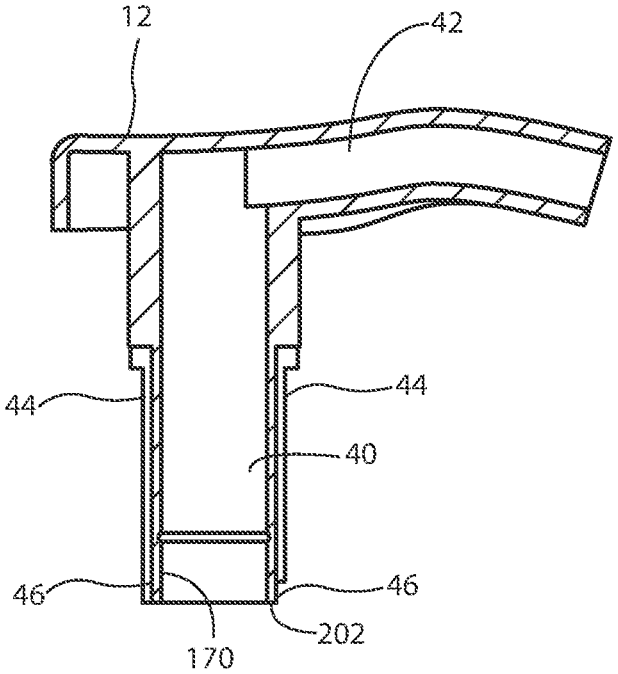
FIG. 3B is a cross-sectional view of the actuator of the hand foam pump of FIG. 1A.
Figure 3C:
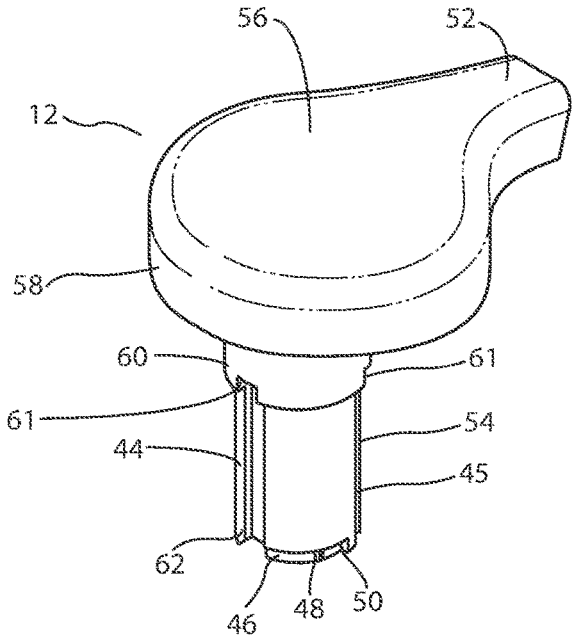
FIG. 3C is a rear-side perspective view of the actuator of the hand foam pump of FIG. 1A.
Figure 3D:
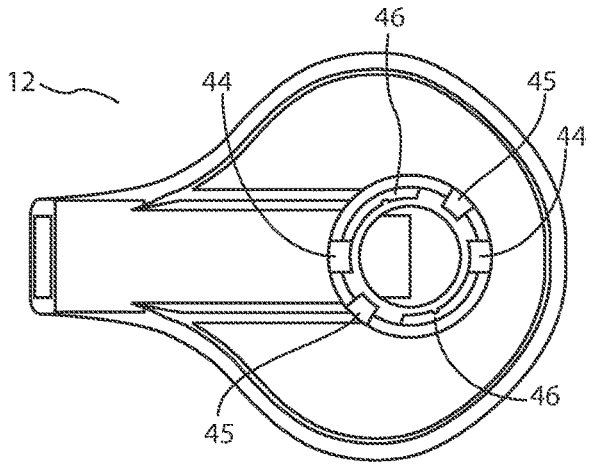
FIG. 3D is a bottom view of the actuator of the hand foam pump of FIG. 3A.
Figure 3E:
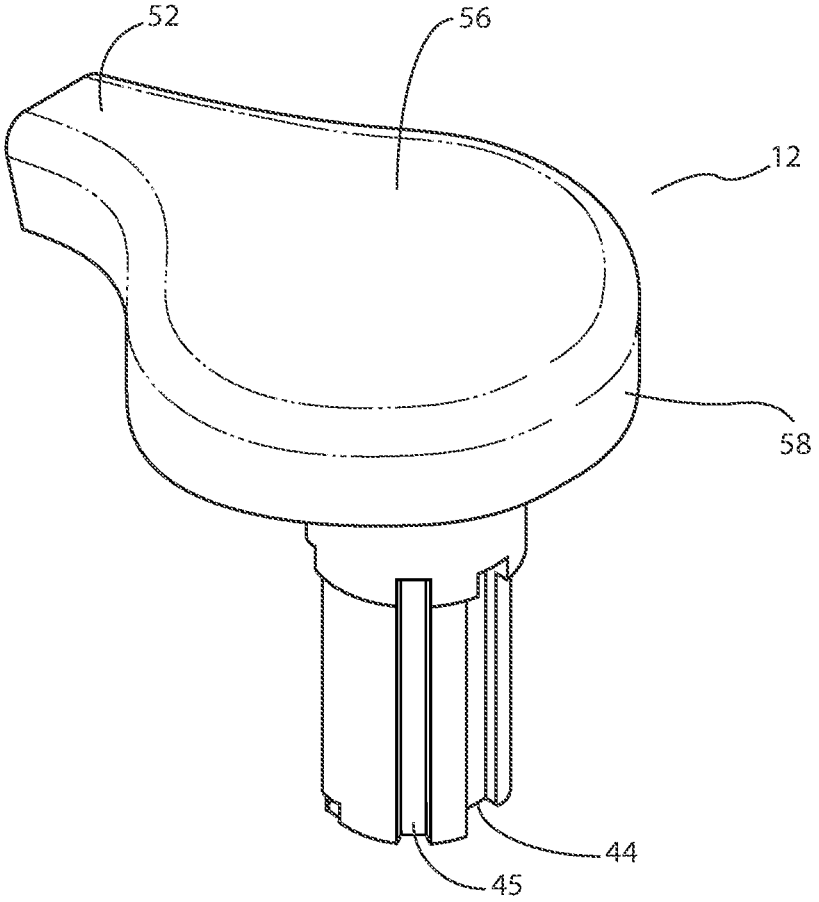
FIG. 3E is a rear perspective view of the actuator of the hand foam pump of FIG. 3A.
Figure 4A:
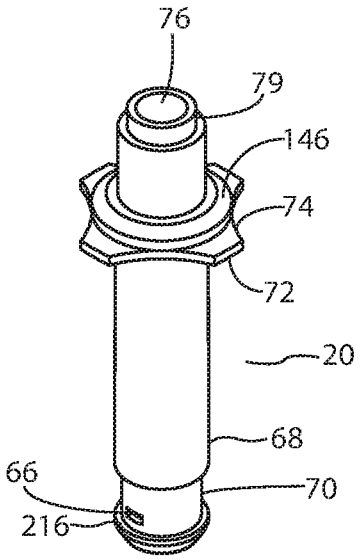
FIG. 4A is a perspective view of the stem of the hand foam pump of FIG. 1A.
Figure 4B:
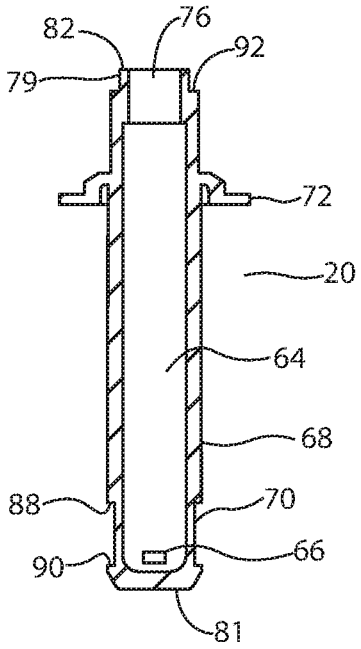
FIG. 4B is a cross-sectional view of the stem of the hand foam pump of FIG. 1A.

With reference to FIGS. 1A-1C, the hand foam pump 10 of the present invention operates as follows. In a first step, to prime the pump 10 a user presses down on the actuator 12 which causes the stem 20 and the air piston 24 to move downwardly within the air cylinder 130 of the pump body 14. During this downwards movement, the liquid piston 26 which is slidably connected to the stem 20, remains stationary in the liquid cylinder 128 of the pump body 14. As the stem 20 moves downwardly within the liquid cylinder 128, the lower liquid ports 66 are opened or uncovered. (See FIGS. 2 and 2A.) Also during downward movement of the actuator 12 and consequently, the stem 20, the diaphragm 28 seals the vent holes 80 in the air piston 24. With the vent holes 80 in the air piston sealed, air is forced to flow through air feed channels 76 (see FIGS. 1B and 4A) between the stem 20 and the air piston 24. The air feed channels 76 are defined by the arcuate cutouts 74 in the upper flange 72 of the stem 20.

In a second step, when hand pressure is removed from the actuator 12, the plastic return spring 18, pushes the actuator 12 upwardly, causing the connected stem 20 and air piston 24 to also move upwardly within the pump body 14. As the stem 20 moves upwardly, the lower liquid ports 66 are again closed or covered by the liquid piston 26, and, at the same time the diaphragm 28 opens or uncovers the vent holes 80 in the air piston 24, thereby allowing air into the air cylinder 130 of the pump body 14. As the lower liquid ports 66 in the stem 20 are closed, by the stem 20 moving upwardly with respect to the liquid piston 26, the resulting pressure differential in the liquid cylinder 128 causes the check valve 30 to open, i.e. causes the check ball 36 to rise upwardly off its seat, thereby causing liquid to be drawn upwardly within the liquid cylinder 128. The liquid is supplied to the liquid cylinder 128 via the dip tube 38 which is inserted within a volume of liquid in a dispensing bottle.

Steps 1 and 2 complete the priming cycle of the hand foam pump 10 of the present invention. In a third step, the actuator 12 is again pushed down by a user causing the stem 20 and the air piston 24 affixed thereto to again move downwardly in the pump body 14. The liquid piston 26 again remains stationary as the stem 20 moves downwardly though the bore 84 of the liquid piston 26. thereby uncovering the lower liquid ports 66 in the stem 20. The downward movement of the stem 20 causes the check ball 36 to seat and close the check valve 30, which in turn causes the liquid in the liquid cylinder 128 to be forced upwardly through the lower liquid ports 66 and into the flow passage 64 of the stem 20.

Simultaneously with the downward movement of the stem 20, downward movement of the air piston 24 (fixed to the stem), causes air to be forced upwardly through the air feed channels 76 between the stem 20 and air piston 24, where the air mixes with the liquid just below the first or lower mesh 158 of the mixing cylinder 22, thereby generating foam. The foamed liquid then travels upwardly through the lower mesh 158 of the mixing cylinder 22 and subsequently through the second or upper mesh 156 of the mixing cylinder 22 and through a vertical flow passage 40 of the actuator 12 and through a horizontal flow passage 42 of the actuator 12, wherein the foamed liquid is dispensed from the actuator 12.

Additional foamed liquid is dispensed with each subsequent downward press of the actuator 12. During all operations, the plastic return spring 18 of the hand foam pump 10 acts as a compression spring and provides the force necessary to drive the stem 20 and attached air piston 24 and liquid piston 26 upwardly on the upstroke.

Operation of the Actuator Locking Features

With reference to FIGS. 3A, 10A and 13A-13B, the actuator 12 of the hand foam pump 10 locks and unlocks to the closure 16 to prevent inadvertent depression of the actuator 12, particularly during shipping. The hand foam pump 10 of the present invention is an up-locking design, i.e. the actuator 12 locks to the closure 16 in the raised or at-rest, position.

During normal operation in the unlocked condition, the actuator 12 reciprocates within the closure 16, with the actuator guide elements 178 of the closure 16 sliding within the vertical guide grooves 44 of the actuator 12. To lock the actuator 12 to the closure 16, starting with the actuator 12 in its raised or at-rest position (see FIG. 13A), the actuator 12 is rotated clockwise, (or the closure 16 is rotated counterclockwise), so that the actuator guide elements 178 of the closure 16 slide within the arcuate locking grooves 46 of the actuator 12 until the actuator guide elements 178 abut locking detents 48 in the arcuate locking grooves 46 of the actuator 12. Further rotation causes the actuator guide elements 178 of the closure 16 to ride or snap over the detents 48, at which point the actuator guide elements 178 are retained within the locking grooves 46 between the detents 48 and stop surfaces 50. (See FIG. 13 B.) Those skilled in the art will appreciate that the directions of rotation of the actuator and closure may be reversed by reversing the location of the arcuate locking grooves 46 and associated detents 48 and stop surfaces 50.

The components of the hand foam pump 10 of the present invention may be made from a variety of plastic materials including polyethylene and polypropylene, among other plastics known to those skilled in the art.

It will be appreciated that a hand foam pump fabricated entirely from plastic components for dispensing foamable liquids has been provided. Every component of the pump including the spring and check ball are made from plastic. Consequently, used pumps do not require disassembly to be recycled. Rather, the all plastic pumps may simply be ground and pelletized and the plastic material reused.

While the present invention has been described with regards to particular embodiments, it is recognized that additional variations of the present invention may be devised without departing from the inventive concept.

What is claimed is:

1. A hand operated dispensing pump for dispensing a fluid from a container, comprising:

an actuator, a stem, an air piston, a liquid piston, a diaphragm, a pump body, a check valve, and a return spring;

wherein the actuator has a flow passage in fluid communication with a flow passage of the stem;

wherein the stem has an upper end and a lower end, wherein at least one fluid inlet port is disposed in the lower end;

wherein the air piston is fixed to the upper end of the stem;

wherein the liquid piston is slidably coupled to the lower end of the stem and is configured to slidably open and close the at least one fluid inlet port such that upon a downstroke of the actuator, the at least one fluid inlet port is opened and upon an upstroke of the actuator, the at least one fluid inlet port is closed;

wherein the pump body has an air cylinder and a liquid cylinder wherein the air piston and the liquid piston reciprocate within the air cylinder and liquid cylinder, respectively;

wherein the at least one fluid inlet of the stem is in fluid communication with the liquid cylinder;

wherein the check valve is disposed below the liquid cylinder and is in fluid communication with the liquid cylinder and the fluid to be dispensed;

wherein at least one air vent is disposed in the air piston and wherein the diaphragm is configured to open and close the at least one air vent;

wherein upon a downstroke of the actuator, the diaphragm closes the at least one air vent and air flows upwardly though at least one air feed channel and mixes with the fluid to be dispensed and, upon an upstroke of the actuator, the diaphragm opens the at least one air vent;

wherein the stem includes an upper flange, the upper flange having at least one arcuate cutout wherein each at least one arcuate cutout in conjunction with walls of the air piston forms each at least one air feed channel; and wherein the return spring is configured to return the actuator to an at-rest position after actuation.

2. The hand operated dispensing pump for dispensing a fluid from a container of claim 1, further including an upper vent in fluid communication with an interior volume of the pump body above the level of the air piston.

3. The hand operated dispensing pump for dispensing a fluid from a container of claim 1, wherein the pump is entirely made from plastic.

4. The hand operated dispensing pump for dispensing a fluid from a container of claim 1, wherein the return spring is an elastic polymer spring.

5. The hand operated dispensing pump for dispensing a fluid from a container of claim 4, wherein the return spring is dome shaped.

6. A hand operated dispensing pump for dispensing a fluid from a container, comprising:

an actuator, a stem, an air piston, a liquid piston, a pump body, a check valve, and a return spring;

the actuator being in fluid communication with the stem;

the air piston and the liquid piston being connected to the stem and configured to reciprocate within respective air and liquid cylinders formed in the pump body;

wherein the liquid piston is slidably coupled to the stem, wherein the liquid piston is configured to slidably open and close at least one fluid inlet port in the stem such that upon a downstroke of the actuator, the at least one fluid inlet port is opened and upon an upstroke of the actuator, the at least one fluid inlet port is closed;

the at least one fluid inlet being in fluid communication with the liquid cylinder;

the check valve being in fluid communication with the liquid cylinder and the fluid to be dispensed;

at least one air vent formed in the air piston wherein the at least one air vent is configured to close upon a downstroke of the actuator and open upon an upstroke of the actuator;

at least one air feed channel for mixing air with the fluid to be dispensed, the at least one air feed channel configured to mix air with the fluid to be dispensed when the at least one air vent is closed;

wherein the at least one air feed channel includes at least one arcuate cutout formed in a flange of the stem; and the return spring being configured to return the actuator to an at-rest position after actuation.

7. The hand operated dispensing pump for dispensing a fluid from a container of claim 6, wherein the at least one air vent is opened and closed by means of a diaphragm.

8. The hand operated dispensing pump for dispensing a fluid from a container of claim 6, wherein a diaphragm is attached to the air piston.

9. The hand operated dispensing pump for dispensing a fluid from a container of claim 6, further including an upper vent in fluid communication with an interior volume of the pump body above the level of the air piston.

10. The hand operated dispensing pump for dispensing a fluid from a container of claim 6, wherein the pump is entirely made from plastic.

11. The hand operated dispensing pump for dispensing a fluid from a container of claim 6, wherein the return spring is an elastic polymer spring.

12. The hand operated dispensing pump for dispensing a fluid from a container of claim 11, wherein the return spring is dome shaped.

13. A hand operated dispensing pump for dispensing a fluid from a container, comprising:

an actuator, a stem, an air piston, a liquid piston, a pump body, and a return spring;

the actuator being in fluid communication with the stem;

the air and the liquid pistons configured to reciprocate within respective air and liquid cylinders formed in the pump body;

the air piston being fixed to the stem and the liquid piston being coupled to the stem, wherein the liquid piston is configured to slidably open and close at least one fluid inlet port in the stem such that upon a downstroke of the actuator, the at least one fluid inlet port is opened and upon an upstroke of the actuator, the at least one fluid inlet port is closed;

the at least one fluid inlet being in fluid communication with the liquid cylinder, b wherein the liquid cylinder is in fluid communication with the fluid to be dispensed;

at least one air vent formed in the air piston wherein the at least one air vent is configured to close upon a downstroke of the actuator and open upon an upstroke of the actuator;

at least one air feed channel for mixing air with the fluid to be dispensed, the at least one air feed channel configured to mix air with the fluid to be dispensed when the at least one air vent is closed;

wherein the at least one air feed channel is formed between the stem and the air piston and includes at least one arcuate cutout formed in a flange of the stem; and the return spring configured to return the actuator to an at-rest position after actuation.

14. The hand operated dispensing pump for dispensing a fluid from a container of claim 13, wherein the at least one air vent is opened and closed by means of a diaphragm.

15. The hand operated dispensing pump for dispensing a fluid from a container of claim 14, wherein the diaphragm is attached to the air piston.

16. The hand operated dispensing pump for dispensing a fluid from a container of claim 13, further including an upper vent in fluid communication with an interior volume of the pump body above the level of the air piston.

17. The hand operated dispensing pump for dispensing a fluid from a container of claim 13, wherein the return spring is an elastic polymer spring.

* * * * *